United States Patent [19]

Blake, deceased

[11] 4,047,956

[45] Sept. 13, 1977

[54] LOW COATING WEIGHT SILVER HALIDE ELEMENT AND PROCESS

[75] Inventor: Ralph Kingsley Blake, deceased, late of Westfield, N.J., by June Arlene Blake, executrix

[73] Assignee: E. I. Du Pont de Nemours and Company, Wilmington, Del.

[21] Appl. No.: 632,728

[22] Filed: Nov. 17, 1975

[51] Int. Cl.[2] ..... G03C 5/32; G03C 1/76; G03C 1/06

[52] U.S. Cl. ..... 96/60 R; 96/60 BF; 96/68; 96/95

[58] Field of Search ..... 96/67, 68, 60, 95

[56] References Cited

U.S. PATENT DOCUMENTS

| | | | |
|---|---|---|---|
| 1,971,430 | 8/1934 | Schneider | 96/84 |
| 2,322,001 | 6/1943 | Ehrenfried | 96/60 R |
| 2,397,452 | 3/1946 | White | 96/68 |
| 2,698,237 | 12/1954 | Land | 96/29 |
| 2,712,995 | 7/1955 | Weyde | 96/64 |
| 2,856,284 | 10/1958 | Hamm | 96/36.3 |
| 2,875,052 | 2/1959 | Weyde | 96/36 |
| 3,178,282 | 4/1965 | Luckey et al. | 96/64 |
| 3,311,473 | 3/1967 | Foster | 96/64 |
| 3,413,122 | 11/1968 | Blake | 96/68 |
| 3,501,298 | 3/1970 | Crawford | 96/67 |
| 3,615,443 | 10/1971 | Smith | 96/64 |
| 3,737,317 | 6/1973 | Nicholas et al. | 96/68 |
| 3,811,894 | 5/1974 | Yonezawa et al. | 96/67 |
| 3,846,133 | 11/1974 | Zorn | 96/74 |

*Primary Examiner*—Mary F. Kelley

[57] ABSTRACT

A novel photographic imaging element which comprises a support, at least one photosensitive silver halide layer, and at least one layer of colorant (e.g., colloidal silver), bleachable with an oxidizing bleach in accordance with images formed in the silver halide layer. Images are formed with such elements by imagewise exposure of the photosensitive silver halide layer and conventional development of the image therein followed by imagewise bleaching the colorant layer with an oxidizing bleach to reduce the optical density in areas of the colorant layer to form an image thereon corresponding to the developed image in the silver halide layer. The combined images in the photosensitive silver halide layer and the imagewise bleached colorant layer form a composite, high quality image having high density and efficiency in the use of silver, providing a substantial reduction in silver halide coating weight over conventional, all-silver halide elements.

15 Claims, 4 Drawing Figures

LOW COATING WEIGHT SILVER HALIDE ELEMENT AND PROCESS

BACKGROUND OF THE INVENTION

1. Field of the Invention

This invention relates to an improvement in the field of photographic silver halide imaging systems and, particularly, to novel silver halide photographic imaging systems employing reduced amounts of photoactive silver halide in conjunction with a chemically bleachable colorant to provide increased image density. These systems are useful in applications in which silver halide photographic elements are used and are particularly useful in X-ray films and graphic arts films, e.g., lithographic films, among others.

2. Description of the Prior Art

Unlike the present invention, photographic silver halide elements of the prior art rely entirely on developed silver to form an image, or in the case of color films, on dye formed imagewise in or near the silver halide layer, the formation of which is catalized by the development of the exposed silver halide. Such elements are not suited to some uses, may require long development times in the case of color films, and may have low transmission density and low or moderate covering power as measured by transmission density. Attempts have been made to produce silver halide photographic films which have high covering power and which therefore require less silver halide to produce an image, e.g. U.S. Pat. No. 3,413,122 and references cited therein. In that patent an element is described having a silver halide emulsion layer and an inner emulsion layer containing unfogged internal silver halide grains. In such an element the inner layer has a very low optical density and no image until an image is formed in it by bringing up the optical density imagewise by development, thereby relying on the nature of the material of the inner layer to be able to develop sufficient image density. Such elements can generate silver images having increased covering power but are still limited to covering power obtainable by development of a silver halide emulsion in situ.

Other elements of the prior art include those having a silver halide layer and an antihalation layer as in U.S. Pat. No. 1,971,430. The antihalation layer was not used as an image-forming layer, and such elements were neither designed for nor used in a process of imagewise bleaching of a colorant layer to produce an image in that layer.

SUMMARY OF THE INVENTION

There has been discovered according to the invention a new method of photoimaging and elements therefor, in which a layer containing a colorant is oxidatively bleached imagewise corresponding to the image of an exposed and developed silver halide material. This new method may utilize a thin, low coating weight layer of silver halide emulsion for image capture and for modulation of the chemical bleaching of another layer containing a colorant. It has been found that the imagewise exposed and developed silver halide layer will imagewise modulate the action of an oxidizing bleach on the colorant layer, thereby producing an image not by bringing up the optical density of a layer but by reducing the optical density of an already colored or opaque layer in the nonimage areas. This enables the use of a colorant which need not be photosensitive to provide or enhance image density and which therefore may be selected from materials that provide high covering power or density, reducing the amount of photosensitive silver halide necessary to provide an image of high optical density and thereby providing an element which is highly efficient in the use of silver.

Accordingly, the invention relates to a photosensitive element comprising a support, at least one layer containing a colorant, and at least one photosensitive silver halide layer, wherein said layer containing a colorant is chemically bleachable with an oxidizing bleach imagewise corresponding to an image formed in said silver halide layer by treating said element over its entire surface with a reagent which will oxidize said colorant. Another element of the invention comprises a support bearing a layer containing both the photosensitive silver halide and the colorant.

Preferred elements may comprise, in order, a film or paper sheet support, at least one layer containing a nonphotosensitive, high tinctorial colorant, and at least one photosensitive silver halide layer contiguous to the colorant layer, wherein the colorant layer is chemically bleachable with an oxidizing bleach imagewise corresponding to an image formed in said silver halide layer, and wherein the combined images of the slver halide layer and the colorant layer after imagewise bleaching have an optical density (referring to density in image areas in excess of density in nonimage areas) greater than the optical density of the image formed in the silver halide layer alone.

The invention also includes a new process of image formation using the above-described elements comprising imagewise exposing the photosensitive silver halide layer to actinic radiation, then developing an image therein, and, no sooner than development of the image in the exposed silver halide layer, chemically bleaching the colorant layer imagewise with an oxidizing bleach corresponding to the image formed in said silver halide layer. This bleaching step bleaches the colorant layer under the nonimage areas of the silver halide layer (i.e., under the areas of the silver halide layer in which there is no developed silver image). Bleaching of those portions of the colorant layer underlying the nonimage areas in the silver halide layer yields an image in those areas of the colorant layer under and corresponding to the image formed in the silver halide layer. The image in the colorant layer thus serves to intensify the image in the silver halide layer. The process may comprise the additional step of fixing (i.e., removing the silver halide remaining in the layer) so as to provide a clear background for the image. The elements of this invention following the process of this invention yield a high density, high speed product with excellent image quality and efficiency in the use of silver.

DESCRIPTION OF DETAILS AND PREFERRED EMBODIMENTS

Figure 1:
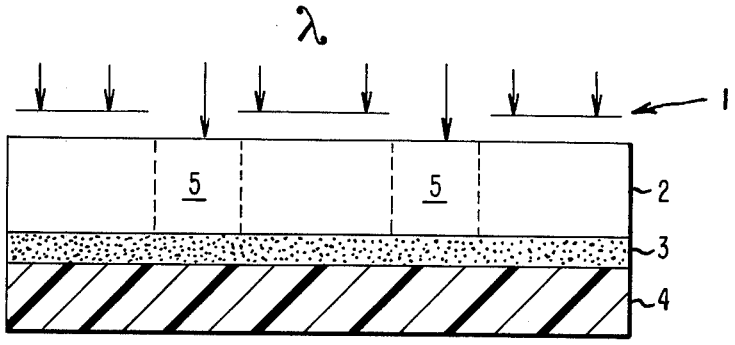
FIG. 1 is a cross-section of an element of the invention during imagewise exposure.

In the photosensitive elements of the invention the layer containing a colorant is chemically bleachable imagewise with an oxidizing bleach, corresponding to an image formed in the photosensitive silver halide layer, whereby the visible image of the imagewise bleached colorant layer is directly under the developed silver image in said silver halide layer. The colorant thereby augments or provides the image density.

By "colorant" is meant a material that has an appreciable optical density, e.g., a dye, colloidal metal, vacuum deposited metal, metal salt, oxide, or other compound which impedes the transmission of light through a layer thereof and therefore has an optical density. The optical density of the colorant must exist at least before imagewise bleaching thereof so that a visible image may be formed by the bleaching. Usually it will also exist before exposure and development of the photosensitive silver halide layer. Since the colorant layer before imagewise bleaching does not have a visible image and has a uniform (i.e., not varying across the surface of the layer) optical density, the elements of the invention are uniformly opaque at least before imagewise bleaching. This is distinguished from a layer of undeveloped silver halide, which has a very low optical density and is not developable by imagewise bleaching. In most practical elements the transmission optical density to visible light (above 500 nanometers) of the colorant layer will be at least 0.5 and, preferably, at least 1.0. In preferred commercial films it will be at least 2.0. In elements having an opaque, reflective support, the resulting image is viewed by reflection and here preferred colorant layers have reflection densities of about 0.5 to 2.0 in the visual region of the spectrum (above 500 nanometers). Preferred colorants are blue, gray, or black. Due to the use of a colorant layer to provide or enhance image density according to the invention, images with high transmission density are obtainable. Such images formed on a transparent support such as a polymeric film are particularly useful in applications such as lithographic and X-ray films which make use of the high transmission density and contrast of the image. The invention also produces images having a high reflection density and may employ element supports of all types, including opaque supports, as described hereinafter.

Of the various materials that may be used as colorants, colloidal metals are preferred, and colloidal silver is particularly preferred since a very small amount of it will produce a high optical density, and it is easily prepared.

Firestine et al. teach, in German Pat. No. 1,234,031, for example, a method for making blue colloidal silver dispersed in a gelatino binder. Other procedures can be found in Herz, U.S. Pat. No. 2,688,601; Peckman, U.S. Pat. No. 2,921,914; McGudern, U.S. Pat. No. 3,392,021; Schaller, U.S. Pat. No. 3,615,789 and others. Colloidal metals are usually so finely divided that individual particles are difficult to resolve microscopically. When coated on a support, these layers have a high covering power, i.e. they produce a high density to actinic light at a low coating weight. Colloidal metals can be produced in a variety of colors and hues. A variety of other colloidal metals may be used instead of colloidal silver within the ambit of this invention. Additionally, one may use metallic silver derived from other processes. Under practical considerations, however, colloidal silver made by conventional procedures appears to be one of the best colorants. Even when it is used, the total amount of silver used to produce an image of given optical density is greatly reduced. Thus, finely divided, gelatino, colloidal silver yields the desired high densities at a substantially lower coating weight of the silver halide layer and lower usage of silver.

Oxidatively bleachable dyes and other coloring materials may also be used satisfactorily in the colorant layer in place of the colloidal metals and other agents described. Any high tinctorial dye, bleachable with an oxidizing bleach in accordance with the image formed within the silver halide layer, may be used. The optical density of the layer of the dye or coloring material should be sufficient so as to increase the over-all image density. Dyes useful within the ambit of this invention include, for example Crystal Violet, Colour Index No. 42555, having the following chemical structure:

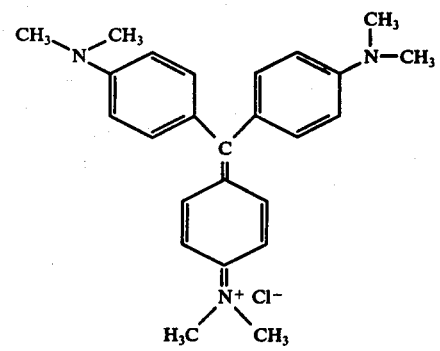

and Pontamine Sky Blue 6BX, Colour Index No. 24400, having the following structure:

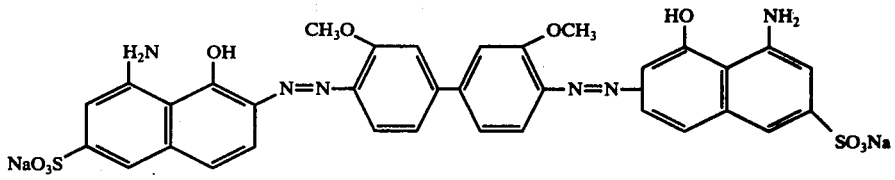

These dyes, suitably dispersed in a binder and coated as the colorant layer or layers of this invention, can be bleached imagewise using suitable bleaching solutions such as potassium chromate or cerric sulfate.

The colorant layer which is in operative association with the silver halide layer, can be of a type and thickness such as to enhance the image in the silver halide layer to any desired degree. From the standpoint of saving silver, the silver efficiency in terms of the total grams of silver in the silver halide layer and any in the colorant layer, is most significant. Therefore, as used herein, the term "silver efficiency" will denote the total grams per square decimeter of silver, including combined silver expressed as the equivalent weight in grams of elemental silver, in the element (in both layers combined in the case of a two layer element of the invention) before processing, divided into the maximum obtainable optical transmission density to visible light (i.e., above 500 nm wavelength) of the final image in the element after processing. For elements of this invention processing includes development of the silver halide layer and imagewise bleaching of the colorant layer. The silver efficiency expression is thereby truly representative of the total amount of silver required to produce an image of given density. When the colorant is silver, the silver efficiency is equivalent to "covering power" as described in the art by Blake et al., "Developed Image Structure",*The Journal of Photographic Science,* Vol. 9 (1961), pp. 14–24 and Jennings, U.S. Pat. No. 3,063,838. For such measurements, and as used herein, "optical density" refers to maximum transmission optical density to visible light (above 500 nm) of the image on a transparent support and does not include any density of the support. Where the support is not transparent, the optical density of the image refers to the optical density that would be obtained with the same image produced on a transparent support. An increase in silver efficiency of an element of the invention of at least 10% of that of the developed but unbleached silver halide layer image along is achievable using the invention. As can be seen from the examples, however, silver efficiency can be increased by well over 150% with elements of the invention.

The photosensitive silver halide layer is preferably coated directly on the colorant layer and preferably is a conventional silver halide emulsion comprising photosensitive silver halide grains dispersed in a binder. There may be employed any of the conventional silver halides, including silver bromide, silver chloride, silver iodide or mixtures of two or more of the halides. Conventional photographic binding agents such as gelatin may also be used. In place of or in addition to gelatin, other natural or synthetic water-permeable, organic, macromolecular colloid binding agents can be used. Such agents include water-permeable or water-soluble polyvinyl alcohol and its derivatives, e.g., a partially hydrolyzed polyvinyl acetates, polyvinyl ether, and acetals containing a large number of extralinear — $CH_2CHOH$ — groups; hydrolyzed interpolymers of vinyl acetate and unsaturated addition polymerizable compounds such as maleic anhydride, acrylic and methacrylic acid ethyl ester, and styrene. Suitable colloids of the last mentioned type are disclosed in U.S. Pat. Nos. 2,276,322, 2,276,323 and 2,347,811. The useful polyvinyl acetals include polyvinyl acetaldehyde acetal, polyvinyl butyraldehyde acetal and polyvinyl sodium o-sulfobenzaldehyde acetal. Other useful colloid binding agents include the poly-N-vinyllactams of Bolton U.S. Pat. No. 2,495,918, the hydrophilic copolymers of N-acrylamido alkyl betaines described in Shacklett U.S. Pat. No. 2,833,650 and hydrophilic cellulose ethers and esters. The silver halide emulsion may be chemically or spectrally sensitized using any of the known conventional sensitizers and sensitization techniques.

For example sulfur sensitizers containing labile sulfur, e.g. alloy isothiocyanate, allyl diethyl thiourea, phenyl isothiocyanate and sodium thiosulfate; the polyoxyalkylene ethers in Blake, et al., U.S. Pat. No. 2,423,549; other nonoptical sensitizers such as amines as taught by Staud et al., U.S. Pat. No. 1,925,508 and Chambers et al., U.S. Pat. No. 3,026,203, and metal salts as taught by Baldsiefen U.S. Pat. No. 2,540,086 may be used to sensitize the photosensitive silver halide layer of this invention. Other adjuvants such as antifoggants, hardeners, wetting agents and the like may also be incorporated in the emulsions useful with this invention.

The emulsions can contain, for example, such known antifoggants as 5-nitrobenzimidazole, benzotriazole, tetra-azaindenes, etc., as well as the usual hardeners, e.g., chrome alum, formaldehyde, dimethylol urea, mucochloric acid, etc. Other emulsion adjuvants that may be added include matting agents, plasticizers, toners, optical brightening agents, surfactants, image color modifiers, etc. The elements may also contain antihalation and antistatic layers in association with the layer or layers of this invention.

In preferred embodiments a nonphotosensitive colorant layer or layers and a photosensitive silver halide layer or layers are usually coated on a suitable photographic film support. Any of the conventional supports may be used including transparent films, opaque and translucent film, plates, and webs of various types. It is preferred to use polyethylene terephthalate prepared and subbed according to the teachings of Alles, U.S. Pat. No. 2,779,684, Example IV. These polyester films are particularly suitable because of their dimensional stability. Supports made of other polymers, e.g., cellulose acetate, cellulose triacetate, cellulose mixed esters, etc., may also be used. Polymerized vinyl compounds, e.g., copolymerized vinyl acetate and vinyl chloride, polystyrene, and polymerized acrylates may also be mentioned, as well as materials described in the patents referenced in the above-cited Alles patent.

Other suitable supports are the polyethylene terephthalate/isophthalates of British Pat. No. 766,290 and Canadian Pat. No. 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al. U.S. Pat. No. 3,052,543 may also be used. Still other supports include metal, paper, plastic coated paper, etc. Gelatin backing layers containing antistatic agents, or applied as anticurling layers may be also employed in elements of the invention. Preferably, a thin, protective, gelatin antiabrasion layer is coated over the emulsion layer.

The silver halide emulsion layers can be applied at very low coating weights, since the density and contrast of the finished element results in a large part from the colorant layer. Thus, the elements of this invention possess the photographic speed of the silver halide and exhibit the density of elements having a much greater silver halide coating weight. Advantageously within this system, the colorant layer usually makes it unnecessary to have an antihalation layer.

Particularly preferred elements of the invention comprise a photographic silver halide emulsion layer in which the average silver halide grain size is from 0.3 to 2.5 microns, the elements having a silver efficiency of at least 120. In more preferred embodiments such elements will have a silver efficiency of at least 150. The colorant of such embodiments may be present in a separate layer which is contiguous to the silver halide emulsion layer and may advantageously be comprised of colloidal silver as the colorant. Such elements having a silver efficiency of at least 300 have been demonstrated by this invention and are preferred.

Other elements of the invention which may be preferred for some uses are those in which the colorant and the photosensitive silver halide are contained within a single layer. By mixing the two and coating them as a single layer on a support, manufacturing costs can be lowered. In such elements it is preferred that the colorant be present in an amount sufficient to increase the silver efficiency of the element by at least 10% of that of such an element in which the colorant is not present. It is further preferred that the layer containing the photosensitive silver halide and the colorant have an optical density to visible light (i.e., above 500 nm) of at least 0.5 before exposure and processing with an optical density of at least 1.0 being particularly preferred.

The elements of this invention may be exposed in the same ways as for conventional silver halide products by exposing the layer containing the photosensitive silver halide to radiation that is actinic for the photosensitive silver halide. For example, the element may be used in a camera and exposed through a lens system, e.g., to visible light. Contact exposure to light, e.g., UV or visible light, through a suitable transparency may also be used. If the film is designed for radiographic purposes, an exposure to X-radiation, in the conventional manner is made. After exposure, the element is processed by developing the silver halide layer followed by imagewise bleaching the colorant layer. The latent image present in the photosensitive silver halide layer is developed using any of the conventional developers containing any of the usual developing agents. Developing is continued until a suitable image of developed silver is formed within the silver halide layer. The length of development is dependent on the type of developer used, temperature of development, photographic speed of the emulsion, etc. After a suitable image has been developed, the element preferably is given a water rinse to remove excess developer from the film and immediately immersed in a chemical bleach bath designed to oxidatively bleach the colorant layer. Many such baths are available dependent only upon the particular material used within the colorant layer. For colloidal silver layers, for example, aqueous potassium ferricyanide or cupric nitrate solutions containing halide ions are particularly efficacious. These bleach solutions may also contain other adjuvants to adjust the pH, for example, or to aid in layer penetration by the oxidant. The bleaching may be carried out by any method of treating the element over its entire surface with bleach, including spraying, wiping, immersing, etc. This oxidative bleaching step will selectively reduce the optical density of the colorant layer (e.g., by 95% or more, as measured after fixing) in the unexposed areas without removing the colorant corresponding to the exposed areas of the silver halide layer. After the bleaching step, the element preferably is water washed and the remaining silver halide is removed by fixing in a conventional fixing bath (e.g. sodium thiosulfate solution). The final high quality, high density, high contrast image preferably is water washed to remove residual amounts of fixer. Alternatively, one may use a combined bleach fix bath ("Blix").

It is thus possible to achieve excellent high density images from low coating weight silver halide elements. The image quality is usually better than the image quality achievable with an all silver halide system. This novel system can be used in all types of imaging systems where silver halide is presently used and will achieve the results described above. Thus, it is applicable to all negative working systems in cine, graphic arts, X-ray and the like. One only needs to adjust the emulsion and balance the silver halide coating weight in relationship to the colorant used in order to achieve the desired results. For example, in the case of X-ray film, where the emulsion is normally coated on both sides of the film support, one may singly coat a suitable colorant layer on both sides overcoated with a reduced level of silver halide emulsion compared to standard X-ray systems. Alternatively, one may coat the two emulsion layers on the same side of the support with a colorant layer interposed between the emulsion layers. Exposure to X-rays is carried out in association with a fluorescent screen on each side of the support. Many other embodiments of the invention can be made wherein a colorant layer is rendered imagewise bleachable with an oxidizing bleach by an exposed and developed silver halide layer.

The particularly preferred element as shown in the drawings includes a support 4 which can be any of the conventional supports for silver halide photographic elements. Polyethylene terephthalate is preferred because of its dimensional stability. The high tinctorial colorant layer is shown as 3. Preferably, it is a thin layer of colloidal silver dispersed in gelatin.

A low coating weight photosensitive silver halide layer shown as 2 is then coated on the colorant layer.

Figure 4:
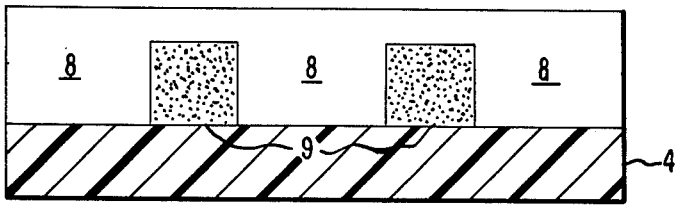
FIG. 4, after fixing of the final image to produce an image with a clear background.

A preferred process of this invention involves the following steps in sequence:

a. Imagewise exposure of the silver halide layer 2, which is comprised of silver halide grains dispersed in an organic polymer or colloid binder - FIG. 1.

b. Conventional development to convert the latent image in areas 5 into a slver image in layer 2 - FIG. 2.

c. Oxidative bleaching in areas 7 of the colorant layer comprised of colloidal silver, which is preferably dispersed in an organic polymer or colloid binder, to a silver salt or complex; the areas 7 correspond to the unexposed silver halide areas 8. Some of the developed silver in image areas 5 is also bleached, leaving substantially unaffected the colloidal silver under the imaged areas 5 - FIG. 3.

d. Removal from layer 2 of the undeveloped silver halide in areas 8, and any bleach-generated silver halide, by conventional fixing leaving a high quality, high density image 9 remaining on the support - FIG. 4.

Figure 2:
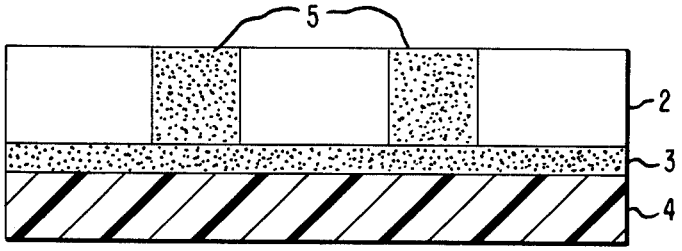
FIG. 2, after conventional development of the image in the photosensitive silver halide layer.
Figure 3:
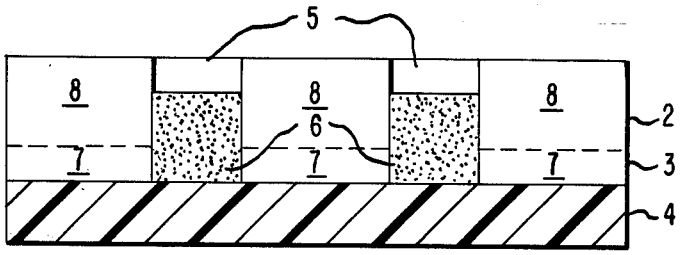

To further describe and exemplify the unique process of the invention, FIG. 1 shows the preferred element being given an exposure through a suitable mask 1, wherein 2 is the low coating weight silver halide layer, 3 is the colorant layer, 4 the support, 5 the latent image formed within the silver halide layer. FIG. 2 shows the same element after contact with a suitable silver halide developing agent. In this drawing the latent image area 5 has now been converted to darkened, relatively low covering power, developed silver. FIG. 3 shows the element after chemical bleaching has occurred and the areas 7 of layer 3 and part of areas 5, representing some of the developed silver, have been subjected to bleach. The areas labeled 6, which are the areas of the colorant layer directly under the developed silver image in layer 2, remain, FIG. 4 as do the undeveloped silver halide areas 8, shows the finished element after fixing has occurred, and the undeveloped silver halide in areas 8 and any regenerated silver salt in areas 5 and 7 has been removed from the binder of the layers. The final image is represented by 9. This novel element permits use of lower coating weight silver halide elements since the high density final image includes the density found inherently within the high covering power, high tinctorial, colorant layer 4. Thus, a considerable cost savings is achieved at no loss in exposure speed, density, gradient and image quality.

This process produces an image upon bleaching of the colorant layer; however, it is usually desired to fix the image so that the nonimage areas are clear, when the support is a transparent film. Various embodiments of the process in addition to the foregoing are possible, e.g.;

Develop - Fix - Bleach - Fix - Wash - Dry
Develop - Bleach - Redevelop - Fix - Wash - Dry
Develop - Fix - Bleach/Fix ("Blix") - Wash - Dry
Develop - Wash - Fix - Wash - Dry - "Blix" - Wash - Dry A water rinse or rinse is preferably used between each step. In all cases it is necessary that development of the photosensitive silver halide layer at least be concurrent with and preferably precede bleaching of the colorant layer.

The bleach may be any material that will oxidize the colorant. Materials such as potassium ferricyanide or cupric nitrate, which are higher in the electromotive series than silver, are used when the colorant comprises colloidal silver.

So-called "Blix" solutions — ones which can oxidize elemental silver and simultaneously fix silver halide - conventionally contain iron chelates (e.g., sodium ferric ethylenediaminetetra-acetic acid and the like) as the oxidizing agent and sodium thiosulfate as the fixing agent. The iron chelate, often causes stain in the geltain layer and is not fully satisfactory. It has been found that aqueous "Blix" solutions containing 1.05–3.15 molar KNCS, 0.04–0.16 molar hydroxyethyl ethylenediaminetriacetic acid, 0.04–0.16 molar $NH_4OH$, 0.045–0.18 molar akali metal bromide, and 0.025–0.1 molar cupric nitrate are excellent in developing elements of the invention. A particularly effective "Blix" solution for the elements of this invention is of the following formula:

| | | |
|---|---|---|
| (A) | 3.5 M KNCS | 300 ml. |
| (B) | Hydroxyethyl ethylenediaminetriacetic acid 30 g. in 80 ml. $H_2O$ + 16 ml. 20% $NH_4OH$ and $H_2O$ to 100 ml.) | 50 ml. |
| (C) | Mixture of 100 ml. 3M KBr, 50 ml. 3M $Cu(NO_3)_2$ and 850 ml. $H_2O$ | 150 ml. |
| | To make a total of 500 ml. of "Blix" solution. | |

The copper forms a chelate with the hydroxyethyl ethylenediaminetriacetric acid ($NH_4$+salt) and is the oxidant while the KNCS acts as a fixing agent. This formula produces excellent results when used with the elements of this invention.

In yet another preferred process mode the elements of this invention can be developed, fixed and dried in the conventional manner and then processed in a "blix" solution, washed and dried. This particular mode is preferred in those instances where automatic processing is currently used and permits the user to process both conventional silver halide elements and the elements of this invention without complicated modifications of equipment.

An additional advantage of the elements of the invention is that they are useful in a process of producing an image corresponding to the nonimage areas of the silver halide layer, whereby a positive image can be obtained. This process is described in Case No. PD-1564 by the same inventor, filed concurrently herewith, the disclosure of which is incorporated herein by reference.

Still another process of the invention comprises, in sequence, exposing a photosensitive silver halide layer imagewise to actinic radiation, treating said silver halide layer with developer solution, contacting a colorant layer with said silver halide layer, and chemically bleaching said colorant layer imagewise corresponding to the image in the silver halide layer. The last step of the process can be performed after the silver halide layer has been separated from the colorant layer.

Elements of the invention make excellent X-ray films. An element particularly suited therefor comprises a visually transparent film support and has at least two colorant layers, as previously described, on the film support, one of said colorant layers being contiguous to one side of said film support and being overcoated with a photosensitive silver halide layer, and one other of said colorant layers being contiguous to the other side of said film support and being overcoated with a photosensitive silver halide layer.

A particularly advantageous aspect of the invention is the high contrast images obtainable therewith. This aspect is of particular importance when the elements are exposed through a halftone screen, resulting in extremely sharp halftone dots for use in lithography. The high contrast is also useful in X-ray applications for resolving fine details in living tissue, wherein the element is exposed in operative association (e.g., contact) with an X-ray intensifying screen. The elements normally employed for such applications have transparent supports, such as polymeriic films.

Other embodiments of elements falling within the ambit of this invention involve mixing the colorant material with the silver halide to achieve a monolayer element. In such an embodiment the included colorant usually would reduce the silver halide emulsion speed. However, this element may be used without speed loss when exposed to more penetrating radiation such as X-rays. In yet another embodiment, the colorant can be deposited directly on the film support (i.e. vacuum deposition and the like). Still other embodiments which fall within the bounds of this invention involve elements with, for example, multilayer coatings of silver halide and colorant layers. For example, one layer of each may be coated on each side of the support. The silver halide may be appliied in two separate coatings with the colorant layer sandwiched iin between. By interposing a reflecting layer between the silver halide stratum and the colorant stratum, the speed of the element can be effectively increased. These products may also contain silver halide developing agents incorporated within the silver halide stratum and activated by contact with an aqueous alkali solution.

THe invention will now be illustrated by the following examples:

EXAMPLE 1

A sample of blue colloidal silver dispersed in gelatin was prepared according to the teachings of Firestine, German Pat. No. 1,234,031. This material was coated on a 0.004 inch (0.0102 cm.) thick polyethylene terephthalate film base made according to Alles, U.S. Pat. No. 2,779,684, Example IV, and subbed on both sides with a layer of vinylidene chloride/alkyl acrylate/itaconic acid copolymer mixed with an alkyl acrylate polymer as described in Rawlins U.S. Pat. No. 3,443,950, and then coated on both sides with a thick anchoring substratum of gelatin (about 0.5 mg/dm$^2$). After drying, the film support containing the layer of colloidal silver had an optical density of about 2.16 to yellow light and had a coating weight of about 4 mg/dm$^2$ calculated as silver in about 13 mg/dm$^2$ gelatin to provide a silver covering power of about 540. A sample of this material was then overcoated with a medium speed, medical x-ray emulsion comprising about 98 mole percent silver bromide and about 2 mole percent silver iodide. The silver halide mean grain size was kept at about 1.0 micron by carefully controlling the variables of rate of addition of the silver nitrate to the ammoniacal halide solution and the ripening time and temperature. The silver halide was precipitated in a small amount of bone gelatin (about 20 g/1.5 moles of silver halide) and washed to remove soluble salts. It was later re-dispersed by vigorously stirring in water and additional gelatin (about 90 g/1.5 moles of silver halide) then added. After adjusting the pH to 6.5 ± 0.1, the emulsion was brought to its optimum sensitivity by digestion at a temperature of about 140° F (about 60° C) with gold and sulfur sensitizing agents. The usual wetting agents, coating acids, antifoggers, emulsion hardeners, etc. were then added. All these procedures, steps and adjuvants are well known to those skilled in the art of emulsion making and other adjuvants can be substituted with equivalent results. The emulsion was coated to a coating weight of about 31 mg/dm² calculated as silver bromide and overcoated with a thin protective layer of hardened gelatin (about 10 mg/dm²). For control purposes, the same emulsion was coated at about the same coating weight on a 0.007 inch (0.0178 cm) thick, blue tinted film support which did not carry the colloidal silver layer. Sample strips from each of these coatings were given a 10 second exposure through an 11 step $\sqrt{2}$ step wedge (D=0 to 3.0) at a distance of about 2 feet from a G.E. 2A Photoflood lamp operating at 24 volts. After exposure, both samples were developed at room temperature (about 25° C) in a standard phenidone/hydroquinone developer solution for about 30 seconds. Under the red safelight conditions of the darkroom, an image could be seen on each sample. The control sample, which did not contain the colloidal silver underlayer, was water washed 15 seconds, fixed for 15 seconds in standard thiosulfate fixer, washed in water 2 minutes and dried. The sample with the colloidal silver underlayer was water washed 15 seconds, and imagewise bleached by placing it in an oxidizer bath for 45 seconds. The oxidizer bath contained the following ingredients:

$Cu(NO_3)_2 \cdot 3\ H_2O$ 75.4g
KBr 4.0g
Lactic Acid 62.4g
$H_2O$ to make 1000 ml The oxidizer bath bleached the colloidal silver layer imagewise corresponding to the developed silver image in the exposed and developed photosensitive silver halide layer, i.e., the areas of the colloidal silver layer under the unexposed areas of the silver halide layer were bleached, while the areas of the colloidal silver layer under the developed silver image remained opaque. After the oxidizer bath, the film was water washed for 15 seconds, fixed in thiosulfate for 15 seconds, water washed 2 minutes and dried. The sensitometric results for this experiment were obtained by reading the various densities from the exposed and processed strips using a MacBath Transmission Densitometer TD-518 with the visual amber light filter (Kodak Wratten 106. This filter removes the light from about 200-500nm. The following total density readings (developed silver plus base) were obtained.

TOTAL DENSITY AT VARIOUS STEPS

| Sample | 1 | 2 | 3 | 4 | 5 | 6 | 7 | 8 | 9 | 10 | 11 |
|---|---|---|---|---|---|---|---|---|---|---|---|
| (1) Control -No Colloidal Ag Underlayer | .15 | .20 | .31 | .54 | .73 | .87 | .93 | .95 | .96 | .97 | .98 |
| (2) Element of This Invention | .04 | .12 | .32 | 1.41 | 2.27 | 2.56 | 2.71 | 2.73 | → | | 2.78 |

(1)Base density = 0.12
(2)Base density = 0.04

The sensitometric results from the H&D plot of these results showed the following.

| Sample | Covering Power** | $D_{min}$ | $D_{max}$ | Gamma | Gradient from to 2.00D | Resolution (1/mm) |
|---|---|---|---|---|---|---|
| Control element | 49 | .15 | .98 | .72 | — | Could read* |
| of the Invention | 329 | .04 | 2.78 | 4.32 | 3.32 | .60 |

*Too much halation
**At $D_{max}$

In order to achieve the densities and gradient shown above, one would have to coat silver halide to a coating weight of more than 100 mg/dm². Thus, a very substantial saving in silver is achieved.

EXAMPLE 2

A high speed, medical x-ray emulsion was coated at about 45 mg/dm² as silver bromide over a colloidal silver layer similar to that described in Example 1. This emulsion is similar to that described in Example 1 except for the average grain size which was about 1.5 to 1.8μ. The emulsion layer was overcoated with a hardened gelatin layer (about 10 mg/dm²). A control, which consisted of the same emulsion coated at about 70 mg/dm² silver halide on each side of the film support, was used in conjunction with this element and both samples were given an industrial type x-ray exposure through a lead screen in contact with an 11 step steel $\sqrt{2}$ step wedge. The control strip was machine processed at about 90° F (32.22° C) in a conventional phenidone/hydroquinone developer in a total time of 90 seconds (develop-fix-wash and dry). The strip representing the element of this invention was hand processed by developing for about 60 seconds in the same developer additionally containing 1 ml. of a solution of 1g. of 1-phenyl-5-mercaptotetrazole in 100 ml. of alcohol per 100 ml. of developer, washed in water 15 seconds, oxidized 1¼ minutes in the oxidizer bath of Example 1, water washed 15 seconds, fixed in thiosulfate 15 seconds, water washed 30 seconds and dried. All processing was done at room temperature (about 25° C).

The following net silver densities were obtained using the procedures of Example 1:

| | STEP | | | | | | | | | |
|---|---|---|---|---|---|---|---|---|---|---|
| | 1 | 2 | 3 | 4 | 5 | 6 | 7 | 8 | 9 | 10 |
| Uniform Densities | .05 | 2.60 | 3.65 | 3.97 | 4.07 | 4.17 | 4.13 | 4.05 | 4.19 | 4.20 |
| Halftone Densities | .03 | .07 | .18 | .46 | .78 | 1.16 | 1.70 | 3.11 | 3.83 | 4.18 |

| | SILVER DENSITY AT STEP | | | | | | | | | | |
|---|---|---|---|---|---|---|---|---|---|---|---|
| Sample | 1 | 2 | 3 | 4 | 5 | 6 | 7 | 8 | 9 | 10 | 11 |
| Control-double side coated at 140 mg/dm² | — | — | .17 | .23 | .32 | .47 | .67 | .94 | 1.31 | 1.77 | 2.29 |
| Of This Invention-45 mg/dm² | — | — | .10 | .05 | .10 | .58 | 1.31 | 1.84 | 2.34 | 2.74 | 2.93 |

The element of this invention produced a high quality, sharp image with contrast and $D_{max}$ higher than the control and a silver efficiency of 183 compared to 35 for the control measured at Step No. 10. This suggests that industrial-type x-ray films might be produced with less than one third the coating weight of silver, a considerable improvement over the prior art.

EXAMPLE 3

A lithographic type emulsion similar to that described in Nottorf, U.S. Pat. No. 3,142,568 was prepared. This emulsion was an aqueous gelatin/ethyl acrylate silver bromochloride type containing about 30 mole percent AgBr and about 70 mole percent AgCl and was brought to its optimum sensitivity with sulfur and gold sensitizing compounds. The emulsion also contained the usual coating aids, antifoggers, hardeners, etc. as well as a typical merocyanine, orthochromatic sensitizing dye. This emulsion was coated over the colloidal silver layer of Example 1 to a coating weight of about 42 mg/dm² as silver bromide. A 21 mg/dm² gel antiabrasion layer was overcoated thereon and a sample was exposed through a 3.0 $D_{max}$ $\sqrt{2}$ step wedge with and without a 150 lines/in. halftone, magenta, positive, square dot screen to a G.E. No. 2A photoflood lamp at a distance of about 2 feet (.61 meters) operating at 40 volts. The duration of exposure was 10 seconds in the developer of Example 1, water rinsed 5 seconds, oxidized 40 seconds in 20 ml. of the following solution diluted with 80 ml. of water:

| | |
|---|---|
| Water | 800 ml. |
| Glacial Acetic Acid | 10 ml. |
| Potassium Alum | 25 g |
| Sodium Borate | 20 g |
| Potassium Bromide | 20 g |
| Potassium Ferricyanide | 60 g |
| Water up to | 1 liter |

The sample was then rinsed in water for 5 seconds and fixed 10 seconds in thiosulfate fixer followed by 10 seconds water wash and drying. The following total densities (base + silver) were measured as in Example 1:

The continuous tone gamma was 12.4, the gradient (at 0.35 to 3.5 density) was 6.9 and the silver efficiency was 437 at Step No. 7. The halftone dots were sharp and had excellent hard edges. In comparison, a standard lithographic element without the colloidal silver underlayer and coated on an anti-halation backed film support at approximately 3 times emulsion coating weight, produced soft fuzzy dots when processed in the continuous tone developer of this example and had a silver efficiency of 98 measured at Step No. 7. This experiment demonstrates the extreme versatility of this invention, since it has not been possible to produce good halftone dots using continuous tone developers. The conventional halftone lith developers are the hydroquinone/sodium formaldehyde bisulfite type which exhibit poor tray life. It has long been an object in the grahic arts industry to process these films in a more stable developer system. The elements of this invention can achieve this result at a much lower silver halide coating weight. To demonstrate the stability of the continuous tone developers, the experiment was repeated after the above developer had been standing for 3 days exposed to air. Similar results to those above were obtained. In comparison, a conventional hydroquinone/sodium formaldehyde bisulfite halftone developer would have deteriorated within 3 days and produced unacceptable dot quality.

EXAMPLE 4

A 0.007 inch thick (0.0178 cm.) polyethylene terephthalate film support similar to that described in Example 1 was coated with high speed, medical x-ray emulsion similar to that described in Example 2 to a thickness of about 73 mg/dm² of silver bromide. A sample of this coating was exposed 10 seconds through a 150 l/in. magenta, positive, square dot halftone screen and a $D_{max}$ 3.0, 11 step, $\sqrt{2}$ step wedge to a G.E. No. 2A photoflood lamp operating at 20 volts. After exposure, the latent image thereon was developed for 15 seconds at 74° F. (about 23.3° C) in the developer of Example 1. The partially developed wet image was then laid on top of a coating containing colloidal silver on polyethylene terephthalate film base, so that the emulsion layer was in direct contact with said colloidal silver layer. The two elements were passed through opposing rubber rollers to insure intimate contact. After 60 seconds contact, the two elements were stripped apart and the film having the silver halide emulsion layer with the developed image was fixed 10 seconds, water washed 15 seconds and dried. The film having the colloidal silver layer was treated for 60 seconds in the following oxidizer bath:

Oxidizer Soln. from Ex. 1; 50 ml.

Polyacrylamide, M.W. 400,000; 5 ml. (lg in 100 ml. $H_2O$)

5-nitrobenzimidazole-$NO_3$ (1g in 100 ml. of 50g/50g ethanol/$H_2O$); 1 ml.

Water up to; 100 ml.

The colloidal silver-containing strip of film was then water washed 10 seconds and dried. A negative image appeared on both strips of film. This experiment demonstrates that the mechanism of this invention can also involve some sort of chemical transfer between the imaged areas in the silver halide and the colorant layers and that the overall effect is to change the rate of opacifier oxidation. The experiment also serves to demonstrate that the novel effects noted do not necessarily result from the imaged upper layer behaving simply as a resist to retard the rate of diffusion of a developing or dissolving bath into the underlayer.

EXAMPLE 5

A sample of film similar to that described in Example 3 (but having about 35 mg/dm² of silver bromide coating weight) was exposed in the same manner as Example 3. This sample was then processed by developing 25 seconds in the developer of Example 1, water washed 5 seconds, and then processed for 70 seconds in the following bleach-fix ("Blix") bath:

| | | |
|---|---|---|
| 3M KNCS | | 300 ml. |
| Hydroxyethyl ethylenediaminetriacetic acid (30 g. in 80 ml. $H_2O$ + 16 ml. 29% $NH_4OH$ + $H_2O$ to 100 ml.) | | 50 ml. |
| 3M KBr | 100 ml. | 150 ml. |
| 3M $Cu(NO_3)_2$ | 50 ml. | |
| $H_2O$ | 850 ml. | |

The sample was then water washed for 30 seconds and dried. The following densitometric readings were obtained using the procedures of Example 1:

| DENSITY AT STEP | | | | | | | | | | |
|---|---|---|---|---|---|---|---|---|---|---|
| 1 | 2 | 3 | 4 | 5 | 6 | 7 | 8 | 9 | 10 | 11 |
| .04 | .05 | 2.10 | 2.88 | 3.08 | 3.19 | 3.27 | 3.34 | 3.50 | 3.49 | 3.46 |

The contrast, speed and density of this element is equivalent to one containing about 3 times the silver halide coating weight but processed conventionally (develop-fix).

EXAMPLE 6

An emulsion similar to that of Example 3 was prepared along with a portion of colloidal silver as described in Example 1. Portions of gelatino-colloidal silver were mixed with portions of the emulsion in the ratio of colloidal silver to emulsion of 1:3, 1:2 and 1:1. These mixtures were then coated on 0.004 inch (0.0102 cm.) thick polyethylene terephthalate base to a silver bromide coating weight of about 40 mg/dm². Each sample was also overcoated with about 11 mg/dm² of gelatin antiabrasion. Samples from each of the dried films were given the same exposure as that described in Example 3 except that the exposure source was operated at 64 volts, and the exposed samples were processed as follows:

20 seconds in developer (see Example 1)

5 seconds water wash 18, 27, 43 seconds respectively in the oxidizer (of Example 4)

30 seconds water wash

Air dry at 100° F. (37.8° C)

The following densitometric readings were obtained using the procedures described in Example 1:

| Sample | (Ag: Emulsion) | 1 | 2 | 3 | 4 | 5 | 6 | 7 | 8 | 9 | 10 | 11 |
|---|---|---|---|---|---|---|---|---|---|---|---|---|
| A | (1:3) | .03 | .09 | .50 | 1.49 | 2.24 | 2.80 | 3.05 | 3.58 | 3.71 | 3.75 | 4.60 |
| B | (1:2) | .02 | .16 | 1.00 | 1.17 | 1.43 | 1.85 | 2.47 | 2.95 | 3.28 | 3.55 | 4.12 |
| C | (1:1) | .02 | .02 | .02 | .60 | .63 | 1.24 | 1.57 | 2.19 | 2.33 | 2.32 | 2.75 |

This example demonstrates the utility of this invention in yet another mode. These samples were considerably slower in overall speed than the dual layer preferred mode. However, a higher density, equivalent to much higher silver halide coating weight, was achieved using the elements and process of this invention.

EXAMPLE 7

An emulsion similar to that described in Example 3 was prepared and coated on a polyethylene terephthalate film support. The emulsion was fogged by exposure to room light for about 5 minutes, then developed in a litho developer (e.g. hydroquinone/sodium formaldehyde bisulfite type) for 2 minutes followed by 45 seconds in an acid stop-bath and 2 minutes in a standard sodium thiosulfate fixer to remove residual silver halide. A 0.005 (0.0127 cm.) inch thick layer of the same emulsion was placed on this fogged underlayer by coating with a doctor knife. This material was then given a $10^{-2}$ second exposure on an Edgerton, Germeshausen and Greer (E.G.&G.) sensitometer through a $\sqrt{2}$ step wedge followed by 20 second development in the developer of Example 1. The sample was then water washed, and bleached 40 seconds in the following oxidizer bath diluted 1 to 4 with $H_2O$:

Acetic Acid (glacial; 10 ml.

Potassium Alum; 25 g.

Sodium Borate; 20 g.

Potassium Bromide; 20 g.

Potassium Ferricyanide; 60 g.

$H_2O$; to 1000 ml.

After bleaching, the sample was water washed, fixed in sodium thiosulfate solution for 1½ min., washed and dried. All processing steps were carried out at room temperature (about 25° C). The imaged areas retarded the bleaching and a high density image resulted with silver efficiency of 117 compared to a silver efficiency of 40 with control when measured at an image density of about 0.90. Thus, fully fogged, high covering power, silver halide can also be used to produce the colorant layer of this invention.

EXAMPLE 8

Example 7 was repeated except that a high speed, medical x-ray emulsion (see Example 2) was used to coat over the fogged layer of Example 7. This emulsion was coated to a coating weight of about 40 mg/dm² as silver bromide. For control, a sample of this emulsion was coated at approximately the same coating weight on a film which did not contain any fogged emulsion.

Samples from both coatings were exposed in the manner described in Example 7. The control strip was developed 1½ minutes in the developer of Example 1, placed in an acid stop bath for 45 seconds, washed, fixed 2 minutes in sodium thiosulfate solution, washed and dried. The sample representing this invention was developed 1½ minutes in the same developer, washed and bleached 75 seconds in the oxidizer bath of Example 7. The sample was then washed, fixed for 2 minutes in thiosulfate solution and dried. All processing steps were carried out at room temperature (about 25° C). The following sensitometry was obtained:

| Sample | Covering Power (at D = .9) | B+F | $D_{Max.}$ |
|---|---|---|---|
| Control | 40 | .04 | .54 |
| Element of this Invention | 129 | .16 | 1.26 |

(B + F = Density of Base + Fog)

The increase in density at a lower silver halide coating weight was thus achieved in this example by using a fogged, silver halide emulsion as the colorant layer.

EXAMPLE 9

A sample of colloidal copper was made in gelatin following the procedures of V. C. Paal and H. Steger, *Kolloid Zeit.*, 30, 88 (1922). The reaction was carried out under a nitrogen atmosphere to prevent the formation of cuprous oxide. A sample of the gelatino-colloidal copper was coated on a 0.007 inch (0.0178 cm.) thick, subbed polyethylene terephthalate, film support using a 0.005 inch (0.0127 cm.) doctor knife. An emulsion similar to that described in Example 3 was coated on the dried colloidal copper layer using a 0.0021 inch (0.0053 cm.) doctor knife (about 40 mg/dm² silver bromide coating weight). A control was prepared comprising the same emulsion at the same coating thickness on a sample of film support without the colloidal copper layer. Both samples were exposed for $10^{-3}$ seconds on the device of Example 7 and both developed for 8 seconds in a developer similar to that of Example 1. The control coating was then placed in an acid stop bath 30 seconds, washed, fixed 2 minutes in sodium thiosulfate solution, washed and dried. The sample representing this invention was washed 15 seconds and bleached 27 seconds in the following bleach bath (diluted 1 to 3 with $H_2O$):

| | |
|---|---|
| Potassium dichromate | 10 g. |
| $H_2SO_4$ (conc.) | 10.7 ml. |
| $H_2O$ | to ml 1000 |

This sample was then water washed, fixed 2 minutes, water washed and dried. The sample of this invention was handled at all times under a nitrogen atmosphere to prevent the formation of $Cu_2O$. All processing steps were carried out at room temperature (about 25° C). Both samples were read and the following densities obtained:

| | DENSITY AT STEP | | | | | | | | | | | | |
|---|---|---|---|---|---|---|---|---|---|---|---|---|---|
| Sample | B+F | 10 | 11 | 12 | 13 | 14 | 15 | 16 | 17 | 18 | 19 | 20 | 21 |
| Control | .04 | .04 | .07 | .16 | .27 | .34 | .41 | .46 | .52 | .53 | .57 | .60 | .66 |
| Element of This Inv. | .10 | .45 | .48 | .52 | .55 | .65 | .55 | .66 | .75 | .98 | 1.00 | 1.43 | 1.39 |

A colloidal copper coolant layer is useful to increase the density of a low coating weight element within the scope of this invention.

EXAMPLE 10

A film similar to that described in Example 3 was prepared comprising a support of polyethylene terephthalate, a blue colloidal silver layer (about 4 mg/dm² calculated as silver), a lithographic emulsion prepared as shown in Example 3 (about 43 mg/dm² as AgBr) and a 21 mg/dm² gelatin anti-abrasion layer. This film was exposed as described in Example 3, developed 30 seconds at 72° F. (22.2° C) in the developer of Example 3, washed in water for 5 seconds, and processed in the following "blix" solution for 60 seconds:

0.1M potassium ferricyanide soln.; 10 ml.
3M potassium thiocyanate soln., 30 ml.
$H_2O$ to; 100 ml.

The film was then washed for 30 seconds. Equivalent results to those described in Example 3 were achieved. Especially surprising was the quality of the dots which were sharp and had superior edge hardness.

EXAMPLE 11

Silver was vacuum deposited at $8 \times 10^{-5}$ torr on 0.0042 inch thick (0.0107 cm.) polyethylene terephthalate film base using a Denton High Vacuum Evaporator Model DV502. About 0.08g. of silver was deposited on a strip of film about 5¾ in. by 12 in. (14.61 cm. × 30.48 cm.). Lithographic emulsion similar to that described in Example 3 was coated thereon using a 0.005 in. doctor blade. For control purposes, this same emulsion was coated on a sample of film base which did not contain the vacuum deposited silver. These samples were exposed for 15 seconds through a $\sqrt{2}$ step wedge at a distance of 2 ft. (0.610 meters) to G.E. Photoflood lamp (300 watts) operating at 15 volts. Both samples were developed 15 seconds in a developer of the following composition:

| | |
|---|---|
| Metol | 12 g. |
| $Na_2SO_3$ | 180 g. |
| Hydroquinone | 48 g. |
| $Na_2CO_3H_2O$ | 270 g. |
| KBr | 7.6 g. |
| $H_2O$ to | 3800 ml. |

The control sample was then fixed 30 seconds in a standard sodiun thiosulfate fixer (all at 73° F. – 22.8° C), water washed and dried. The element of this invention was developed in the same developer, water washed, bleached 30 seconds in the following solution:

| | |
|---|---|
| NaBr | 30 g. |
| $K_4Fe(CN)_6$ | 200 g. |
| $(NH_4)_2S_2O_8$ | 38 g. |
| $Na_2N_4O_{10} \cdot 10\ H_2O$ | 1.31 g. |
| $H_2O$ | 1 liter |

-continued

| |
|---|
| Diluted 1 to 5 with $H_2O$ |

This sample was then water washed, fixed in the same fixer as the control, water washed and dried. The following total density readings (developed silver plus base) were obtained:

| Sample | Covering Power (at $D_{max}$) | $\Delta D^{(1)}$ | TOTAL DENSITY AT VARIOUS STEPS 1 | 2 | 3 | 4 | 5 | 6 | 7 | 8 |
|---|---|---|---|---|---|---|---|---|---|---|
| Control | 125 | 1.80 | .10 | .11 | .12 | .16 | .25 | .50 | 1.13 | 1.90 |
| Sample of This Inv. | 244 | 2.68 | .66 | .71 | .61 | .66 | 1.08 | 1.87 | 3.04 | 3.34 |

(1)ΔD is herein defined as $D_{max}$ less $_{min}$.

Thus, vacuum deposited silver served to increase the density of the silver image in the same manner as the colloidal metals.

EXAMPLE 12

In a manner similar to that described in Example 11 lead was vacuum deposited on a polyethylene terephthalate film base support and a silver halide emulsion coated thereon as shown in Example 11. This material was exposed and developed as described therein followed by bleaching 20 seconds in the following bleach bath:

| | |
|---|---|
| Acetic Acid (glacial) | 10 ml. |
| $KAl(SO_4) . H_2O$ | 25 g. |
| Sodium Borate | 20 g. |
| KBr | 20 g. |
| $K_3Fe(CN)_6$ | 60 g. |
| $H_2O$ to | 1 liter |
| Diluted 1 to 1 with $H_2O$ | |

Sodium Borate; 20 g.

After washing, the sample was fixed in potassium thiocyanate fixer for about 30 seconds, washed and dried. All processing steps were carried out at room temperature (about 25° C). Total density reading were as follows:

| TOTAL DENSITY AT VARIOUS STEPS 1 | 2 | 3 | 4 | 5 | 6 | 7 | 8 | 9 | 10 | 11 |
|---|---|---|---|---|---|---|---|---|---|---|
| — | .79 | 1.00 | 1.02 | 1.64 | 1.73 | 1.85 | 2.25 | 2.31 | 2.22 | 2.70 |

Thus, the layer of vacuum deposited lead increased the density of the silver image in the same manner as the colloidal metals.

EXAMPLE 13

In a manner similar to that described in Example 11, copper was vacuum deposited on a polyethylene terephthalate film support and a silver halide emulsion coated thereon as shown in Example 11. The copper layer thickness was about 0.00014 inches (0.00036 cm.) and had an optical density of 3.6–4.0. The silver halide emulsion coating weight was about 16 mg/dm² recorded as silver bromide. This material was exposed for 15 seconds through a $\sqrt{2}$ step wedge at a distance of 2 ft. (0.61 meters) to the exposure device of Example 11 operating at 40 volts then developed for 4 seconds in the developer of Example 11 followed by a water wash and a bleach for 10 seconds in the following bleach solution:

| | |
|---|---|
| $K_2Cr_2O_7$ | 9.6 g. |
| $H_2SO_4$ (conc.) | 10.7 ml. |
| $H_2O$ to | 1 liter |
| Diluted 1 to 2.1 with water | |

The film strip was then water washed for about 30 seconds and fixed 40 seconds in the following solution:

| | |
|---|---|
| KNCS | 50 g. |
| Potassium Alum | 10 g. |
| $H_2O$ to | 1 liter |

For control, a sample strip which did not contain the vacuum deposited copper layer was exposed, developed and fixed in the same solutions. All processing steps were carried out at room temperature (about 25° C). The following results were obtained:

| | ΔD | TOTAL DENSITY AT VARIOUS STEPS 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| Control | 0.77 | .05 | .06 | .08 | .20 | .31 | .47 | .58 | .64 | .70 | .73 | .76 | → | | .82 |
| Of This Inv. | 1.28 | .05 | .19 | .37 | .47 | .57 | .57 | .57 | .72 | .89 | .99 | 1.18 | 1.02 | 1.27 | 1.33 |

Thus, a layer of vacuum deposited copper increased the density of the silver image in the same manner as the colloidal metals.

EXAMPLE 14

A sample of colloidal palladium in gelatin was prepared following the procedures of Paul and Amberger, Berichte, 32, 124, (1904). A sample of this material was coated on a piece of polyethylene terephthalate film using a 20 mil doctor knife. After drying, this material was overcoated with the same emulsion described in Example 9 using a 2.1 mil doctor knife. The coating weight was about 20 mg/dm² as silver bromide. For control, a coating without the colloidal palladium was prepared. Both samples were exposed as described in Example 9 and developed 7 seconds in the same developer. The control was then fixed as described therein. The sample containing the colloidal palladium layer was washed 15 seconds, bleached 1½ minute in $HNO_3$ (diluted 1:3 with water), washed 45 seconds and fixed 1½ minutes in thiosulfate solution. Both samples were washed and dried. All processing steps were carried out at room temperature (about 25° C). The following net densities (less base + fog) were obtained.

| | DENSITY AT STEP | | | | | | | | | |
|---|---|---|---|---|---|---|---|---|---|---|
| | 12 | 13 | 14 | 15 | 16 | 17 | 18 | 19 | 20 | 21 |
| Control | .06 | .09 | .11 | .16 | .20 | .32 | .34 | .37 | .37 | .37 |
| Of This Inv. | .10 | .27 | .30 | .31 | .47 | .46 | .61 | .66 | .86 | .97 |

The increase in net density was achieved using a colloidal palladium underlayer as the colorant layer of this invention.

EXAMPLE 15

Colloidal silver similar to that described in Example 1 was prepared and coated on 0.0042 in. (0.0107 cm.) thick subbed polyethylene terephthalate film base to a coating weight of about 8.7 mg. silver/dm². After drying, an emulsion similar to that described in Example 3 was prepared and coated over the colloidal slver coating to a coating weight of about 37 mg/dm² as silver bromide and dried. A 21 mg/dm² hardened gelatin overcoat was coated over said emulsion layer. For control purposes, the same emulsion plus over-coat was coated on polyethylene terephthalate film support without the colloidal silver underlayer but having an antihalation layer on the reverse side of the support from the silver halide emulsion layer. The coating weight of this control emulsion was about 96 mg/dm² as silver bromide and said control is a typical product designed for the lithographic industry. Two sample strips from said control coating and one sample strip from the coating representing this invention were given a 20 second contact exposure at f/16 through a 21 step $\sqrt[4]{2}$ step wedge and a 133 l/in. magenta positive screen in a Klimsch Camera manufactured by Klimsch and Co., Frankfurt, Germany. Following this exposure, all samples were processed as follows:

1. develop 1¾ min. in conventional lithographic chemistry (hydroquinone-sodium formaldehyde bisulfite developer) - about 25° C
2. water wash 5 seconds.
3. fix ½ min. in standard thiosulfate fixer containing a small amount of potassium iodide (about 18 ml. of 0.5M KI/900 ml. fixer). - about 25° C.
4. water wash ½ min.
5. dry.

One control strip and the sample representing this invention were then further processed at 25° C for ¾ min. in the following "blix" solution:

$H_2O$; 800 ml.
Potassium ferricyanide; 50 g.
Ammonium thiocyanate; 100 g.
Sodium dichromate; 3.5 g.
Sodium phosphate (dibasic); 30 g.
Di-sodium-ethylene-diamine-tetraacetic acid; 5 g.
$H_2O$; 1 liter These two samples were then water washed ½ min. and dried. Of course, the films were handled under "red" safelight conditions until the first fixing step (3), above. After that time, they were handled in normal room lights. All of the above samples were evaluated for the quality of dots following the procedures discussed in Nottorf, U.S. Pat. No. 3,142,568. These dots were evaluated by microscopic observations of the characteristics halftone reproduction of edge sharpness, dot si e, opacity of small dots, etc. and subjective ratings of same on a numerical scale wherein, 1.0 is excellent
2.0 is very good
3.0 is acceptable
4.0 is poor
5.0 or more is unacceptable This scale is used for all 50% dots (midtones) and 10 and 90% dots (shadow and highlights). Decimals are used to allow for estimates of intermediate quality. The overall density of each step was also read using a MacBeth Densitometer (yellow filter) and the following results were obtained:

| Sample | DOT QUALITY 10% | 50% | 90% |
|---|---|---|---|
| Control - no "blix" | 3.0 | 2.0 | 3.5 |
| Control - "blix" | 5.0 | 2.5 | 3.0 |
| Of this invention | 2.0 | 1.0 | 2.0 |

| Sample | DENSITY READINGS AT STEP: 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| Control-no "blix" | .05 | .07 | .09 | .13 | .18 | .22 | .26 | .30 | .35 | .40 | .44 | .50 | .57 | .61 | .66 | .77 | .81 | .89 | .92 | 1.00 |
| Control - "blix" | — | — | — | — | — | .03 | .05 | .09 | .13 | .15 | .18 | .23 | .26 | .28 | .31 | .35 | .42 | .46 | .49 | .51 |
| Of this invention | .02 | .03 | .07 | .12 | .17 | .21 | .25 | .37 | .46 | .53 | .61 | .58 | .70 | .91 | 1.02 | 1.06 | 1.31 | 1.37 | 1.87 | 2.76 |

This example demonstrates the remarkable utility of the element of this invention. Superior dots and extrememly high density are achieved at less than ½ the silver halide coating weight. Additionally, this example demonstrates that the element of this invention can be processed conventionally before bleaching in accordance with the process of this invention. This discovery allows the user to take full advantage of the invention without changing any automatic processors so that the element of the invention can be processed with conventional silver halide elements. Finally, it was found that the "blix" solution described continued to produce excellent results even after 3 days open air aging.

EXAMPLE 16

Colloidal silver similar to that described in Example 1 was coated on 105g. paper body stock coated on both sides with clear, high density polyethylene and then gel subbed on one side only. The colloidal silver was coated at about 3.1 mg silver/dm² and dried. An emulsion similar to that described in Example 3 was coated over the colloidal silver layer to a coating weight of about 32 mg/dm² as silver bromide. An 11 mg/dm² hardened gelatin layer was over coated on said emulsion layer. A sample strip of 3 in. by 1 in. from this coating was exposed through an 11 step $\sqrt{2}$ step wedge and a 150 l/in. magenta positive square dot contact screen for 12 seconds to a G.E. 2A photoflood source at 2 feet operating at 44 volts. The strip was then processed by developing 1¾ min. in the developer of Example 15, fixed ½ min. in the fixer of Example 15, water washed ½ min. and dried. The dry strip was then bleached by passing through a small "Rollarprint" developer/stabilizer processor made by the U.S. Photo Suppy Co., 6478 Slego Mill Rd., Washington 12, D.C. The machine processes 3½ inch wide material through two 25 ml. trays squeegeeing the element between rubber rollers after treatment in each tray. Both trays were filled with the "blix" solution described in Example 15. After passing through this processor in 10 seconds, the sample was water washed ½ min., dried and the densities read on a reflection densitometer as follows:

| STEP | 1 | 2 | 3 | 4 | 5 | 6 | 7 | 8 | 9 | 10 |
|---|---|---|---|---|---|---|---|---|---|---|
| Density | .07 | .07 | .08 | .25 | .59 | .82 | 1.10 | 1.40 | 1.62 | 1.65 |

Close examination showed good, sharp 10, 50 and 90% halftone dots.

EXAMPLE 17

A sample of colloidal copper was made following the procedures described in Example 9 except for the nitrogen atmosphere. By allowing air to enter the reaction the final product was colloidal cuprous oxide. During the reaction, the product was observed turning color from the deep red of colloidal copper to the red-purple of $Cu_2O$. This material was coated on the same film as Example 9 using a 0.010 inch (.0254 cm.) doctor knife and overcoated with the emulsion of Example 9 to the thickness described therein. A control was prepared coating the same emulsion at the same thickness on film support without colloidal $Cu_2O$. Both samples were exposed as described in Example 9 and developed for 15 seconds in the developer of Example 9 but containing 1.5 ml. of 1-phenyl-5-mercaptotetrazole (1 g. in 100 ml. ethanol) per 100 ml. of developer solution. The control was then washed, fixed in thiosulfate, washed and dried. The sample representing this invention was washed, bleached in the bleach bath of Example 9 diluted 1:3 with water for 3 min., water washed and fixed in the following fixer for 1½ min:

| | |
|---|---|
| Potassium thiocyanate | 32 g. |
| Aluminum potassium sulfate | 5 g. |
| $H_2O$ to | 500 ml |

This sample was then washed and dried. All processing steps were carried out at room temperature (about 25° C). The step densities are shown below:

| SAMPLE | B+F | 1 → | 16 | 17 | 18 | 19 | 20 | 21 |
|---|---|---|---|---|---|---|---|---|
| | | DENSITY AT STEP | | | | | | |
| Control | .03 | .03 | .10 | .14 | .26 | .41 | .54 | .60 |
| Of this invention | .20 | .20 | .20 | .23 | .81 | 1.67 | 1.95 | 1.80 |

Thus a layer of cuprous oxide increased the density of the silver image in the same manner.

EXAMPLE 18

A sample of colloidal mercury was prepared according to the procedures of Sauer and Steiner, Kolloid, Zeit., 73, 42 (1935). This material was coated on subbed polyethylene terephthalate as described in Example 9 and over coated with a gelatin layer of about 0.005 in. (0.0127 cm.) thickness. An emulsion layer similar to that described in Example 9 was coated over this gelatin layer to a coating weight of about 30 mg/dm² of silver bromide. The sample was exposed as in Example 9 and then processed as follows (at room temperature, about 25° C):

Develop 15 seconds in a standard X-ray developer (metol/hydroquinone) containing additionally 1 ml. of 1-phenyl-5-mercaptotetrazole solution (1 g./100 ml. of alcohol) per 100 ml. of developer.

Water wash 15 seconds.

Fix in thiosulfate 45 seconds.

Water wash 15 seconds.

Bleach 5 minutes in the following solution:

6 gm. $KMNO_4$ 10 ml. $H_2SO_4$ (conc.)

Dilute to 1 liter with $H_2O$

Water wash 30 seconds.

Bleach 7½ minutes in the following solution:

10 g. $K_2Cr_2O_7$ 10.7 ml. $H_2SO_4$ (conc.)

Dilute to 1 liter with $H_2O$

Water wash 30 seconds.

Fix again in thiosulfate for 45 seconds.

Water wash 2 minutes.

Dry.

For control purposes a sample of film having only the silver halide emulsion layer (at the same coating weight) was exposed, developed, fixed, washed and dried. The densitometric measurements on both samples showed that the control had a ΔD image density increase of 0.4 and the sample of this invention had an image density increase of 1.02.

EXAMPLE 19

A sample of yellow colloidal silver was prepared following conventional techniques. The reaction was carried out in a gelatin solution by reducing silver chloride to silver metal using hydrazine as the reducing agent. The yellow colloidal silver remains in suspension and the suspension is filtered to remove silver sludge. The gel-to-silver ratio was 6.17 in this case. This procedure is well known in the art and is described, for example, in Reistotter, "Production of Colloidal Solution of Inorganic Substances", published by Th. Steinkopf, Leipzig, (1927) among others. Some of this material was mixed one to one with blue colloidal silver of Example 1 (gel to silver ratio about 2.0) to yield a material having a reasonable constant absorption from 4000 to 7500A and having a black color. Samples of both the yellow and the black colloidal silver were coated on film supports as described in Example 1 to yield coating weights of about 6 mg/dm² as silver. These samples were overcoated with high speed medical x-ray emulsions as described in Example 2 and a 10 mg/dm² gelatin abrasion layer applied thereon. For control purposes, a coating of emulsion alone was also prepared. The silver halide coating weights were about 45–50 mg/dm² as silver bromide. Samples from each coating were exposed through a $\sqrt{2}$ step wedge as described in Example 1. The samples containing colloidal silver were processed as follows (at room temperature, about 25° C):

Develop 20 seconds in standard X-ray developer (metol/hydroquinone).

Water rinse 5 seconds.

Fix in thiosulfate solution containing 20 ml. of 0.5MKI/1000 ml. of solution for 30 seconds.

Water rinse 30 seconds.

Bleach 15 seconds in the following solution:

| | |
|---|---|
| Solution A[1] | 50 ml. |
| Polyacrylamide (MW 400,000, 1 g/100 in $H_2O$ | 10 ml. |
| 1M $AlCl_3$ | 10 ml. |
| $H_2O$ to | 100 ml. |

[1]Solution A:

| | |
|---|---|
| Water (Dist.) | 800 ml. |
| Acetic Acid (glacial) | 10 ml. |
| Potassium Alum | 25 g. |
| Sodium Borate | 20 g. |
| Potassium Bromide | 20 g. |
| Potassium Ferricyanide | 60 g. |
| $H_2O$ to | 1 liter |

The following sensitometric results (visual yellow light filter) were obtained following the procedure of Example 1:

| | |
|---|---|
| $Na_2CO_3$ | 67.5 g. |
| KBr | 3.3 g. |
| $H_2O$ | 750 ml. |
| Diluted 1:3 with water | |

The sample strip was then water washed 30 seconds and bleached 50 seconds in the same oxidizer bath as described in Example 7 but diluted 1:5 with water. The strip was then water washed 30 seconds, fixed 1½ minutes in thiosulfate solution, water washed 2 minutes and dried all at room temperature (about 25° C). For control purposes a sample strip containing only the emulsion described above was processed in the same manner but without the bleaching step. Sensitometric results were as follows (where $\gamma$ = gamma):

TOTAL DENSITY AT VARIOUS STEPS

| Sample | B+F | 1 | 2 | 3 | 4 | 5 | 6 | 7 | 8 | 9 | 10 | 11 |
|---|---|---|---|---|---|---|---|---|---|---|---|---|
| Control Yellow | .10 | .10 | .19 | .37 | .57 | .76 | .90 | .98 | 1.03 | 1.05 | 1.05 | 1.05 |
| Colloidal Silver | .06 | .07 | .10 | .19 | .52 | .73 | .88 | .96 | 1.01 | 1.04 | 1.05 | 1.05 |
| Black Colloidal Silver | .10 | .11 | .14 | .99 | 2.04 | 2.82 | 3.53 | 3.87 | 4.12 | 4.30 | 4.48 | 4.47 |

DENSITY AT STEP

| Sample | B+F | $\gamma$ | 1 | 2 | 3 | 4 | 5 | 6 | 7 | 8 | 9 | 10 | 11 |
|---|---|---|---|---|---|---|---|---|---|---|---|---|---|
| Control | .05 | .38 | — | — | — | — | — | — | — | .11 | .25 | .33 | .47 |
| Of This Invention | .04 | 1.05 | — | — | — | — | — | .10 | .24 | .39 | .66 | .78 | .81 |

| Sample | 12 | 13 | 14 | 15 | 16 | 17 | 18 | 19 | 20 | 21 |
|---|---|---|---|---|---|---|---|---|---|---|
| Control | .58 | .59 | .61 | .65 | .72 | .68 | .76 | .74 | .77 | .80 |
| Of This Invention | .96 | 1.56 | 1.61 | 1.74 | 1.88 | 2.09 | 2.18 | 2.30 | 2.24 | 2.30 |

The yellow colloidal silver produced an image which did not appear to produce high densities using the yellow filter. With a blue filter, however, the densities are appreciably higher. The mixed yellow-blue produced a good, high density black image.

EXAMPLE 20

Developer was incorporated in a lithographic type emulsion similar to that described in Example 3 in the following manner.

| | |
|---|---|
| Emulsion | 50 g. |
| Gelatin | 10 g. |
| $H_2O$ | 140 ml. |
| Hydroquinone | 2 g. |

Stir at 25° C for 15 min.
Stir at 43° C for 30 min.
Add hardening and wetting agents
Stir 15 min.

This material was then coated on a sample containing the colloidal silver layer (approx. 6 mg/dm² of silver) of Example 1 to a coating weight of about 30 mg/dm² of silver bromide. A sample strip from this coating was given a $10^{-3}$ second exposure through a $\sqrt{2}$ step wedge to a E.G.&G. sensitometer (see Example 7). Following exposure, the image was developed by placing the exposed strip in the following activator solution for 20 seconds at room temperature (about 25° C).

EXAMPLE 21

In a like manner as that described in Example 20, metol and hydroquinone were incorporated in a medical x-ray emulsion described to that described in Example 2 as follows:

| | |
|---|---|
| Emulsion | 75 g. |
| Gelatin | 5 g. |
| $H_2O$ | 100 ml. |
| Metol | 0.3 g. |
| Hydroquinone | 1.5 g. |

The emulsion was coated on a support containing a layer of colloidal silver as described in Example 20 to a coating weight of about 40 mg/dm² as silver bromide and a sample strip from this dried coating was given a $10^{-2}$ second exposure on the E.G.&G. sensitometer as described in Example 20. The exposed sample was then processed 40 seconds in the activator solution of Example 20, water washed 30 seconds, bleached 40 seconds in the oxidizer bath of Example 20, water washed 30 seconds, fixed 1½ minutes in the thiosulfate solution, water washed 2 minutes, and dried. For control purposes, a sample strip containing only the above described silver halide emulsion coated thereon was exposed and processed described herein except for the bleaching step. All processing was carried out at room temperature (about 25° C). The following sensitometric data were obtained:

| | DENSITY AT STEP | | | | | | | | | |
|---|---|---|---|---|---|---|---|---|---|---|
| Sample | B+F | γ | 14 | 15 | 16 | 17 | 18 | 19 | 20 | 21 |
| Control | .04 | .73 | .09 | .13 | .20 | .30 | .42 | .51 | .63 | .81 |
| Of This Invention | .04 | 1.82 | .20 | .33 | .64 | .78 | 1.15 | 1.48 | 1.75 | 1.98 |

EXAMPLE 22

A 0.1 g. sample of Pontamine Sky Blue 6BX dye (Colour Index No. 24400) was thoroughly mixed in 100 ml. of a 5% aqueous gelatin solution along with a suitable wetting agent and gelatin hardener. The dye-containing gelatin layer was coated on a suitably subbed polyethylene terephthalate film support using a 0.006 in. (.15 cm.) doctor knife. After drying, a layer of lithographic silver halide emulsion similar to that described in Example 3 was applied thereon to a coating weight of about 29 mg/dm² as silver bromide. A sample of this material was then exposed through a $\sqrt{2}$ step wedge at a distance of about 2 ft. (.61 meters) to a 300 watt G.E. Photoflood lamp operating at 20 volts with an exposure time of 10 seconds. The exposed material was then processed at room temperature (about 25° C) as follows:

| | |
|---|---|
| $Ce(SO_4)_2$ | 16.6 g. |
| $H_2SO_4$(conc.) | 50 ml. |
| $H_2O$ to | 1 liter |

For control purposes a sample of film having only the silver halide emulsion (at the same coating weight) was exposed, developed, fixed, washed and dried. The following results were obtained:

| Sample | $D_{min.}$ | $D_{max.}$ | ΔD |
|---|---|---|---|
| Control | .06 | 2.20 | 2.14 |
| Of This Invention | .11 | 2.64 | 2.53 |

The densities were read using a MacBeth Densitometer with a yellow filter.

EXAMPLE 23

In a manner similar to that described in Example 22 a gelatin layer containing Crystal Violet Dye, Colour Index No. 42555 was prepared, coated on film support, dried and over coated with the same silver halide emulsion. A sample of this material was exposed 30 seconds in the same manner but with the light source operating at 40 volts. The exposed film was processed as described in Example 22 but only 45 seconds in the bleach bath. A control strip containing only a silver halide layer was also exposed, developed, fixed, washed and dried. All process steps were carried out at room temperature (about 25° C). The following results were obtained:

| Sample | $D_{min.}$ | $D_{max.}$ | ΔD |
|---|---|---|---|
| Control | .07 | 1.82 | 1.75 |
| Of This Invention | .07 | 2.43 | 2.36 |

These examples show that bleachable dyes may be used as the colorant layer within this invention.

The novel elements of this invention can be used in any system which employs silver halide as the photosensitive element. Any colorant material bleachable in accordance with the image formed in the silver halide can be used in this invention. One only need select the proper bleach or oxidant necessary to remove the particular colorant layer used.

EXAMPLE 24

A direct positive emulsion similar to that described in Pritchett, U.S. Pat. No. 3,752,674, Aug. 14, 1973 was prepared. This emulsion was prepared from a monodispersed silver bromo-iodide emulsion (about 1 mole percent iodide) sensitized with gold and thiaborane as described in the above Pritchett patent and contained an orthochromatic spectral sensitizing dye. The cubic silver halide grains had an edge length of about 0.19μ. This emulsion was coated over the blue colloidal silver layer of Example 1 to a total coating weight of about 50 mg/dm² as silver bromide equivalent. A sample from this coating was exposed for 10 seconds to a G.E. No. 2A Photoflood source operating at 33 volts, at a distance of 2 feet (about 0.61 meters) through an 11-step $\sqrt{2}$ step wedge. The exposed material was then processed as follows at 70° F (about 21° C):

Develop for 15 seconds in standard X-ray developer (metol/hydroquinone).

Water wash 30 seconds.

Bleach 15 seconds in the following solution:

| | | |
|---|---|---|
| Acetic Acid (glacial) | 10 ml. | 50 ml. |
| Potassium Alum | 25 g. | |
| Sodium Borate | 20 g. | |
| Potassium Bromide | 20 g. | |
| Potassium Ferricyanide | 60 g. | |
| $H_2O$ to | 1 liter | |
| Polyacrylamide, M.W. 400,000, lg/100 $H_2O$ | | 10 ml. |
| 1M $AlCl_3$ | | 10 ml. |
| $H_2O$ to | | 1 liter |

Water wash 15 seconds.

Fix in thiosulfate solution for 30 seconds.

Water wash 30 seconds.

Dry.

A direct positive image of high quality was obtained. The following sensitometric properties were found.

| | | | DENSITY AT EXPOSURE STEP NO. | | | | | |
|---|---|---|---|---|---|---|---|---|
| Block Speed (at D=1.5) | Gamma | $D_{max.}$ | 5 | 6 | 7 | 8 | 9 | 10 |
| 3.9 | 8.2 | 4.77 | 4.74 | 4.77 | 4.20 | 1.73 | 0.01 | 0.00 |

This example demonstrates that the objects of this invention can be achieved using both positive and negative - working silver halide layers and that colorant layers of this invention can be used to enhance either type image when processed as described herein.

I claim:

1. A process of forming a composite image in a photosensitive element that comprises a support, a photosensitive silver halide emulsion layer on said support, and a contiguous colorant-containing layer in which the colorant is selected from the group consisting of an oxidatively bleachable dye, fogged silver halide, colloidal silver, colloidal mercury, colloidal palladium, colloidal copper, a copper film, and a lead film; which process comprises:

1. imagewise exposing said photosensitive silver halide emulsion layer to actinic radiation, and developing the resultant latent image, and
2. immersing said photosensitive element in an oxidizing bleach bath which diffuses through the unexposed areas so as to chemically bleach those areas of the colorant-containing layer which are under the nonimage areas of the silver halide emulsion layer, leaving an image in those areas of the colorant-containing layer which are directly under the image formed in the silver halide emulsion layer, whereby the image in the silver halide emulsion layer is retained, and at the same time is intensified by the image in the colorant-containing layer.

2. The process of claim 1 containing the additional step of removing undeveloped silver halide from said silver halide emulsion layer.

3. The process of claim 1 wherein the colorant is colloidal silver.

4. The process of claim 1 wherein the colorant is colloidal silver and the oxidizing bleach is potassium ferricyanide or cupric nitrate containing halide ions.

5. The process of claim 1 wherein said photosensitive silver halide emulsion layer is exposed through a halftone screen.

6. The process of claim 1 wherein said colorant-containing layer has a uniform optical density of at least 0.5 before development of said silver halide layer.

7. The process of claim 1 wherein the combined images of said silver halide emulsion layer and said colorant-containing layer, after imagewise exposure to actinic radiation, development, and bleaching, have an optical density greater than the density of the image formed in the silver halide emulsion layer alone.

8. The process of claim 1 wherein the silver halide of said photosensitive silver halide emulsion layer has an average grain size of 0.3 to 2.5 microns, and the covering power of the element is at least 120.

9. The process of claim 1 wherein said photosensitive silver halide emulsion layer is interposed between two of said colorant-containing layers.

10. The process of claim 1 wherein said support is visually transparent and there are at least two colorant-containing layers on the support, one of said layers being contiguous to one side of said support and being overcoated with a photosensitive silver halide emulsion layer, and one of said layers being contiguous to the other side of said support and being overcoated with a photosensitive silver halide emulsion layer.

11. The process of claim 1 wherein the photosensitive silver halide emulsion layer is exposed in operative association with an X-ray intensifying screen.

12. The process of claim 1 wherein the chemical bleaching is effected by the application of an aqueous solution comprising (a) 1.05–3.15 molar KNCS, (b) 0.04–0.16 molar hydroxyethyl ethylenediamine-triacetic acid, (c) 0.04 –0.16 molar $NH_4OH$, (d) 0.045–0.18 molar alkali metal bromide, and (e) 0.025–0.1 molar cupric nitrate.

13. A process of forming a composite image in a photosensitive element that comprises a clear polyester film support, a photosensitive silver halide emulsion layer, and an underlayer of colloidal silver in gelatin, which process comprises:

1. imagewise exposing said photosensitive silver halide emulsion layer to actinic radiation, and developing the resulting latent image,
2. immersing said photosensitive element in a chemical bleach bath which diffuses through the unexposed areas so as to chemically bleach those areas of the colloidal silver-containing underlayer which are under the nonimage areas of the silver halide emulsion layer, leaving an image in those areas of underlayer which are directly under the image areas of the silver halide emulsion layer, and
3. fixing the aforesaid image in the colloidal silver-containing underlayer by treatment with a thiosulfate fixer to remove undeveloped silver halide; whereby the image in the silver halide emulsion layer is retained, and at the same time is intensified by the image in the colloidal silver-containing underlayer.

14. A process of forming a composite image in a photosensitive element that consists essentially of a monolayer of photosensitive silver halide emulsion mixed with colloidal silver, on a support, which process comprises the steps of 1. imagewise exposing said monolayer to actinic radiation, and developing the resulting latent image, and
2. immersing said photosensitive element in an oxidizing bleach so as to chemically bleach the unexposed areas of the monolayer, but not the exposed areas, whereby the image developed in step 1) is intensfied by the colloidal silver contained in the monolayer.

15. The process of claim 15 wherein after the bleaching step the element is water-washed, and the remaining silver halide is removed by fixing in sodium thiosulfate solution.

* * * * *